US007733036B2

(12) United States Patent
Buij

(10) Patent No.: US 7,733,036 B2
(45) Date of Patent: Jun. 8, 2010

(54) METHOD AND CIRCUIT FOR DRIVING GAS DISCHARGE LAMPS USING A SINGLE INVERTER

(75) Inventor: Arnold Willem Buij, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 245 days.

(21) Appl. No.: 12/091,113

(22) PCT Filed: Oct. 20, 2006

(86) PCT No.: PCT/IB2006/053870

§ 371 (c)(1),
(2), (4) Date: Apr. 22, 2008

(87) PCT Pub. No.: WO2007/049205

PCT Pub. Date: May 3, 2007

(65) Prior Publication Data

US 2008/0252227 A1 Oct. 16, 2008

(30) Foreign Application Priority Data

Oct. 26, 2005 (EP) ..... 05109989

(51) Int. Cl.
*H05B 37/02* (2006.01)

(52) U.S. Cl. ..... 315/307; 315/224; 315/269

(58) Field of Classification Search ..... 315/224, 315/246, 307, 308, DIG. 5, DIG. 7, 312, 315/324, 268, 269
See application file for complete search history.

(56) References Cited

U.S. PATENT DOCUMENTS

| | | | | |
|---|---|---|---|---|
| 5,402,043 | A * | 3/1995 | Nilssen | 315/307 |
| 5,841,239 | A * | 11/1998 | Sullivan et al. | 315/219 |
| 6,023,131 | A | 2/2000 | Okita | |
| 6,255,785 | B1 | 7/2001 | Yang et al. | |
| 6,975,077 | B2 * | 12/2005 | Izumi et al. | 315/209 R |
| 2004/0183466 | A1 | 9/2004 | Moisin | |
| 2004/0189216 | A1 | 9/2004 | Choi | |
| 2005/0012466 | A1 | 1/2005 | Chen et al. | |
| 2005/0116662 | A1 | 6/2005 | Sanchez | |

FOREIGN PATENT DOCUMENTS

| | | | |
|---|---|---|---|
| CA | 2488763 | A1 | 6/2005 |
| EP | 07939154 | A1 | 10/1996 |
| WO | WO2004072733 | A2 | 8/2004 |

* cited by examiner

*Primary Examiner*—David Hung Vu

(57) ABSTRACT

For driving one or more gas discharge lamps (2) to conduct or to block at any time and at the same time, a rectangular high voltage is generated from a high DC voltage, an alternating voltage with respect to a reference voltage (V−) is generated from the rectangular voltage, the alternating voltage is supplied to first electrodes (4) of the lamps, second electrodes (6) of the lamps are selectively connected to the reference voltage, a current flowing through each lamp is stabilized (26), the alternating voltage is filtered to provide a filtered voltage, a property of the filtered voltage is measured to provide a control signal, the control signal is used to control the frequency of the rectangular voltage, and the filtering has a response characteristic which is substantially identical to a response characteristic provided by a lamp when conducting and means for said stabilizing of current flowing through the lamp.

10 Claims, 2 Drawing Sheets

METHOD AND CIRCUIT FOR DRIVING GAS DISCHARGE LAMPS USING A SINGLE INVERTER

FIELD OF THE INVENTION

The invention relates to a method for driving gas discharge lamps as described in the preamble of claim 1. The invention also relates to a circuit for driving gas discharge lamps as described in the preamble of claim 4.

BACKGROUND OF THE INVENTION

U.S. Pat. No. 6,023,131 discloses a backlight device for a liquid crystal display (LCD), which comprises a high-voltage generating means, whose output can be controlled. The high-voltage generating means comprises an inverter for generating an alternating output voltage. The output of the inverter is connected to first electrodes of three gas discharge lamps, which can emit red, green and blue light, respectively. A second electrode of each lamp is connected to a ground voltage line via a separate first electronic switch. The inverter is connected to a high-voltage source via a second electronic switch. A control circuit is connected to the switches to let them conduct or to block. Only when the second switch is conducting the high voltage is supplied to the inverter, so that it will generate the alternating voltage. The three first switches are controlled such that only one first switch is conducting at a time. There is an off-interval of not conducting of all first switches between on-times of different first switches being conducting. Only the selected one lamp will emit light.

With said prior art backlight device each lamp may emit light during a small part, in particular less than one third, of time only. Therefore, to obtain a certain amount of light during some time on average a relatively high peak current must flow through the lamps. Therefore also, the inverter, the switches and the lamps must be suitable to handle such high peak currents, which causes them to be relatively bulky and expensive.

OBJECT OF THE INVENTION

An object of the invention is to solve the drawbacks of the prior art method and circuit as described above.

SUMMARY OF THE INVENTION

The above object of the invention is achieved by providing a method for driving gas discharge lamps as described in claim 1. Accordingly, each lamp can be controlled to emit light or not individually for all of the time, and in practice from 1% to 100% of the time. Therefore, peak intensities and peak currents may be lower than before for obtaining the same average intensity during some time, so that the circuit and the lamps need to be less powerful and less expensive.

The above object of the invention is achieved also by providing a circuit for driving gas discharge lamps as described in claim 4.

BRIEF DESCRIPTION OF THE DRAWINGS

The invention will become more gradually apparent from the following exemplary description in connection with the accompanying drawing. In the drawing.

DETAILED DESCRIPTION OF EXAMPLES

Figure 1:
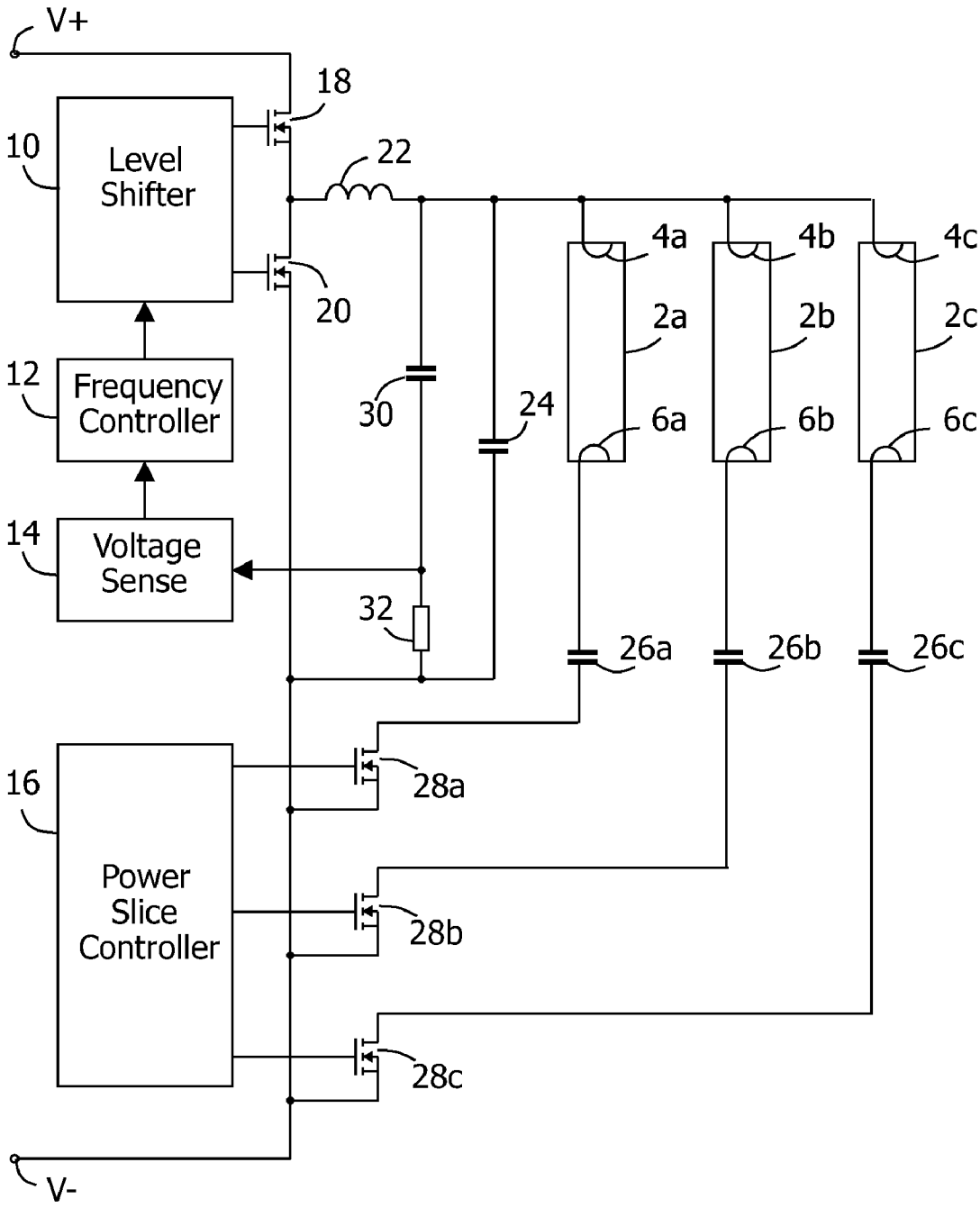
FIG. 1 shows a circuit diagram of an embodiment of a ballast for three gas discharge lamps according to the invention.

The circuit diagram shown in FIG. 1 represents a ballast for three gas discharge lamps 2*a*, 2*b* and 2*c* (indicated in general by 2). The lamps 2 may be suitable to emit light of the same or of different parts of the visible spectrum, such as a red, green and blue spectrum parts. In particular, the spectrum parts are chosen such that, dependent on control of light emissions by the lamps 2, a suitable part (a color gamut) of the chromaticity diagram as defined by the CIE (Commission Internationale de l'Êclairage) is covered. Control of light emission by a gas discharge lamp 2 may be carried out by changing a magnitude of an alternating lamp current through the lamp 2, changing a frequency of the alternating lamp current, possibly by changing a duty cycle of a substantial rectangular voltage.

Although in here an example using three lamps 2 is described, the invention is applicable for any number of lamps 2, each emitting light of any part of the spectrum.

Each lamp 2 (2*a*, 2*b*, 2*c*) has a first electrode 4 (4*a*, 4*b*, 4*c*, respectively) and a second electrode 6 (6*a*, 6*b*, 6*c*, respectively). The electrodes 4 and 6 may be of a type which are heated by heating means to promote ignition of the lamps 2. For simplicity of the drawings and the description such heating means are not shown and are not described in detail in here.

The circuit of FIG. 1 further comprises an inverter controller 10, a frequency controller 12, a voltage sense circuit 14, a power controller 16, a half-bridge inverter output stage consisting of electronic switches, in particular MOSFET's, 18 and 20 in series between high-voltage lines V+ and V−, a resonant or tank circuit consisting of an inductor 22 and a capacitor 24 in series between a connection node of said bridge switches 18, 20 and the V− line, and for each lamp 2 (2*a*, 2*b*, 2*c*) in series between its second electrode 6 (6*a*, 6*b*, 6*c*, respectively) and the V− line a stabilizing capacitor 26 (26*a*, 26*b*, 26*c*, respectively) and an electronic switch, in particular a MOSFET, 28 (28*a*, 28*b*, 28*c*, respectively).

During operation the frequency controller 12 compares a reference voltage (not shown) with a voltage received from the voltage sense circuit 14 to provide an error voltage. The frequency controller comprises a voltage controlled oscillator (VCO, not shown) which generates a rectangular voltage of which the frequency is dependent on said error signal. Said rectangular voltage is supplied to the inverter controller 10. The inverter controller 10 comprises level shifters (not shown) to supply complementary control signals to control inputs (gates) of the half-bridge switches 18 and 20, so that they are switched on and off alternately and a rectangular high voltage is generated at the connection node of said switches 18 and 20 and inductor 22. The resonant circuit of inductor 22 and capacitor 24 is designed to resonate on a resonance frequency which is basically the same as the frequency of the rectangular voltage at the connection node of the half-bridge switches 18 and 20. As a result, a basically sinusoidal voltage will be generated at the connection node of inductor 18 and capacitor 24 of the resonant circuit.

The power controller 16 is connected to control inputs (gates) of the electronic switches 28, called lamp switch hereinafter. The power controller 16 may receive data from some exterior data source (not shown) by which the power controller may control the lamp switches 28. If a lamp switch 28 is conducting an alternating current may flow through the lamp 2 connected in series with that lamp switch 28. By providing appropriate data to the power controller 16 and, accordingly, appropriate pulse widths of control signals to the lamp switches 28 any light color within the gamut of the lamps 2 can be obtained.

The power controller 16 may control the lamp switches 28*a*, 28*b*, 28*c* to conduct or to block individually, that is, to conduct or to block at any time and at the same time with other ones of the lamp switches 28. That poses a problem for controlling the light intensities (or lamp power) provided by the lamps 2 as will be explained now.

A gas discharge lamp 2 almost behaves like a constant voltage source, that is, a lamp voltage (across the lamp only) is almost constant. Suppose one wants to keep the light emission power of the lamp 2 constant. One could measure a current through a lamp 2 and control it to keep it constant. With the lamp voltage being constant the light emission power will be kept constant then. A current trough a lamp 2 can be changed by changing the impedance of the capacitor 26 in series with the lamp 2, that is, by changing the frequency of the current. However, said frequency applies for all series circuits of a lamp 2 and a capacitor 26. Therefore, controlling the frequency for keeping a current through one lamp 2 constant will influence a current through an other lamp 2, so that a voltage across the series circuits changes, the frequency is changed to keep the current in said other lamp 2 constant, with the result that the current through the first mentioned lamp 2 changes, which needs control to keep it constant, and so on, so that the control of lamp currents may become unstable and light flicker may occur.

If one wanted to control a total current flowing through the total load of conducting lamps 2, instead of controlling currents through individual lamps 2, some additional series load would be required to measure the total current. That would mean loss of energy. Also, at any time one should know which or how many lamps 2 are conducting to determine a reference or goal value for the total current. This is not practical.

According to the invention, in parallel to the total load represented by the lamps 2 there is connected a filter having an impedance and response characteristic which are identical (in theory) to the impedance and response characteristic provided by a lamp 2 and the stabilizing capacitor 26 in series therewith. As shown in FIG. 1 said filter can be a simple RC-network of a capacitor 30 and a resistor 32 in series between the first electrodes 4 of the lamps 2 and the V− line. Then, the following conditions should preferably be met:

$$C_{30} \cdot R_{32} = C_{26} \cdot R_{lamp} \quad (1)$$

wherein:

$C_{30}$ is the value of capacitor 30, $R_{32}$ is the value of resistor 32, $C_{26}$ is the value of a stabilizing capacitor 26, and $R_{lamp}$ is the resistance value of a lamp 2 on average when conducting.

With such a filter 30, 32, a node thereof will have a voltage which is proportional to a voltage at a node of a series circuit of a lamp 2 and a capacitor 26 for all values of the frequency of the current supplied to the lamps 2. When the frequency changes, as explained below by control, the impedance of the capacitors 26 changes, so that a voltage across the series circuits of a lamp 2 and a capacitor 26 and the filter 30, 32 changes. With the lamps 2 and capacitors 26 being substantially identical all individual lamp currents are in phase, so that their influence on a control of the frequency will be identical and a stable control can be provided.

The voltage sense circuit 14 is supplied with an alternating voltage appearing at the node of capacitor 30 and resistor 32 of the filter. The voltage sense circuit 14 determines a value of a property of said voltage, such as a root mean square (RMS) value, which can be used as feed back signal value in control loop, comprising the frequency controller 12 also, to control the power of the lamps 2.

It is observed that the lamps of a lighting system, such as a backlight device, may have different resistance values when conducting. At the time of manufacturing, lamps of the same type may have a resistance value distribution of up to +/−10%. Such a variation may be compensated for by inserting a resistor in series with the lamp and possibly by adjusting such resistor to meet the above condition (1). In practice, applying the mean value of said distribution will be suitable to meet the above condition (1) and to achieve the wanted frequency and power compensations without using an additional component in series with each lamp.

Numerical example values are:

the high DC input voltage (V+ minus V−) may be 300V;

the voltage at the first electrodes 4 of the lamps 2 may be 400 Vrms;

the frequency of the lamp current may be 20 to 200 kHz;

the control signal to a lamp switch 28 may have a repetition frequency of 75 to 150 Hz.

Figure 2:
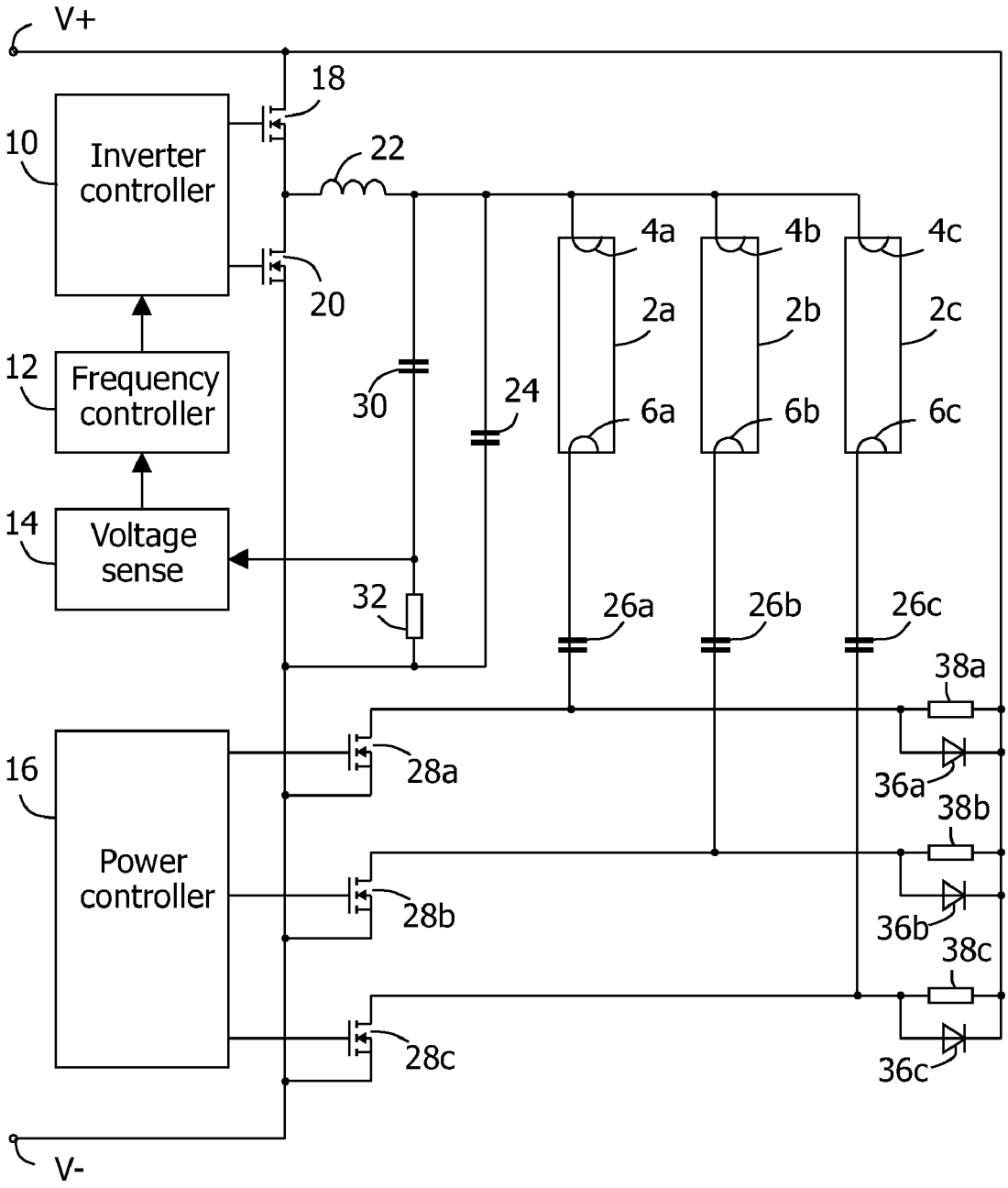
FIG. 2 shows the circuit diagram of FIG. 1 supplemented by over-voltage protection means.

FIG. 2 shows a diagram of a preferred embodiment of the circuit according to the invention. The circuit of FIG. 2 is supplemented with respect to the diagram shown in FIG. 1 by the addition of over-voltage protection means to protect the lamp switches 28. The over-voltage protection means comprises for each lamp 2 (2*a*, 2*b*, 2*c*) a diode 36 (36*a*, 36*b*, 36*c*, respectively). With the lamp switch 28 being a MOSFET, said diode 36 is connected to a drain of the lamp switch 28 and to one of the high voltage DC lines. In the example of FIG. 2 the anode of diode 36 is connected to the drain of the lamp switch 28 and the cathode of the diode 36 is connected to the V+ line. By this it is prevented that, with the lamp switch 28 being deselected, a high voltage builds up across an inherent drain-source capacitance of the lamp switch 28. Without the diode 36 said voltage might reach a value to five times the high DC voltage and the lamp switch 28 would be destroyed.

More preferably, the over-voltage protection means comprises for each lamp switch 28 (28*a*, 28*b*, 28*c*) a resistor 38 (38*a*, 38*b*, 38*c*, respectively), which is connected in parallel to the corresponding diode 36 (36*a*, 36*b*, 36*c*, respectively). With the lamp switches 28 being deselected, the resistors 38 keep the drain voltage of the lamp switches 28 near the high DC voltage at line V+. In this way the parasitic drain-source capacitance of the MOSFET switches 28 is minimized. Such a resistor 38 may have a high value of, for example 100 kOhm to 1 Mohm.

Still more preferably, the over-voltage protection means may comprise also a zener diode (not shown) which is connected in series with said diode 36. In the example of FIG. 2 the cathode of said zener diode would be connected to the cathode of the diode 36 (across which the resistor 38 might still be connected). A single zener diode can be used for all lamp switches 28. In this way a threshold of the drain voltage of a MOSFET lamp switch 28 above which a high frequency current is diverted from flowing through the MOSFET to flow through the diode 36 connected with the MOSFET and the zener diode is increased to the voltage of the V+ line plus the zenervoltage of the zener diode.

The invention claimed is:

1. Method for driving one or more gas discharge lamps (2), comprising generating a substantial rectangular high voltage from an input high DC voltage (V+-V−), generating an alternating voltage with respect to a reference voltage (V−) from the rectangular voltage, supplying the alternating voltage to first electrodes (4) of the lamps, and selectively connecting second electrodes (6) of the lamps to the reference voltage (V−), characterized in that, for each lamp a current flowing through the lamp is stabilized (26), the alternating voltage is filtered to provide a filtered voltage, a property of the filtered voltage is measured to provide a control signal, the control signal is used to control the frequency of the rectangular voltage during its generation, and the filtering has a response characteristic which is substantially identical to a response characteristic provided by a lamp when conducting and means for said stabilizing of current flowing through the lamp.

2. Method according to claim 1, characterized in that, the response characteristic provided by a lamp when conducting and means for stabilizing current flowing through the lamp is a response characteristic of a resistance of the lamp when conducting and, in series with said resistance, a capacitance as stabilizing means for the current through the lamp.

3. Method according to a claim 2, characterized in that, a product of a resistance value and of a capacitance value of the response characteristic of the filtering may differ by +10% to −10% from a product of the resistance value of the lamp when conducting and the capacitance value of the current stabilizing means.

4. A gas discharge lamp driver circuit for driving one or more gas discharge lamps (2), comprising an inverter (10, 18, 20), a resonant circuit (22, 24), for each lamp (2) a lamp switch (28), and a lamp switch controller (16), wherein the inverter is connected to high DC voltage lines (V+ and V−), the resonant circuit is connected to an output of the inverter and to one (V−) of said DC lines, an output of the resonant circuit is connected to first electrodes (4) of the lamps, second electrodes (6) of the lamps are connected to one (V−) of said DC lines via a corresponding one of the lamp switches (28), the lamp switch controller is connected to the lamp switches, and the lamp switch controller being suitable to control the lamp switches individually to conduct or to block, characterized in that, for each lamp (2) and a lamp switch (28) connected to the lamp a current stabilizing means (26) is connected in series with the lamp switch, a filter (30, 32) is connected to the first electrodes to receive and to filter the alternating voltage to provide a filtered voltage, a voltage sense circuit (14) is provided to receive and to measure a property of the filtered voltage to provide a control signal, a frequency controller (12) is provided to receive the control signal and to generate inverter drive signals, which are supplied to the inverter to generate the rectangular voltage with a frequency which is dependent on the control signal, and the filter has a response characteristic which is substantially identical to a response characteristic provided by a lamp when conducting and the current stabilizing means.

5. Circuit according to claim 1, characterized in that, the response characteristic provided by a lamp when conducting and the current stabilizing means is a response characteristic of a resistance of the lamp when conducting and, in series with said resistance, a capacitance of the current stabilizing means.

6. Circuit according to a claim 5, characterized in that, a product of a resistance value and of a capacitance value of the response characteristic of the filter may differ by +10% to −10% of a product of the resistance value of the lamp when conducting and the capacitance value of the current stabilizing means.

7. Circuit according to claim 4, characterized in that, with a lamp switch (28) being a MOSFET, there is provided an over-voltage protection means for said MOSFET lamp switch which is suitable to limit a drain-source voltage of the switch.

8. Circuit according to claim 7, characterized in that the over-voltage protection means comprises a diode (36), which is connected to divert a drain-source current to a high-voltage line (V+).

9. Circuit according to claim 8, characterized in that the over-voltage protection means comprises a resistor (38), which is connected in parallel to the diode (36).

10. Circuit according to claim 8, characterized in that the over-voltage protection means comprises a zener diode, which is connected to increase a drain voltage above which the diode (36) and the zener diode conduct to the high-voltage line (V+).

* * * * *